US006256968B1

(12) United States Patent
Kristen

(10) Patent No.: US 6,256,968 B1
(45) Date of Patent: Jul. 10, 2001

(54) VOLUMETRIC VACUUM CONTROL

(75) Inventor: Hanns J. Kristen, San Anselmo, CA (US)

(73) Assignee: Tilia International, Kowloon (HK)

( * ) Notice: Subject to any disclaimer, the term of this patent is extended or adjusted under 35 U.S.C. 154(b) by 0 days.

(21) Appl. No.: 09/290,735

(22) Filed: Apr. 13, 1999

(51) Int. Cl.[7] ..... B65B 31/00
(52) U.S. Cl. ..... 53/512; 53/405
(58) Field of Search ..... 53/512, 510, 434, 53/432, 405, 138.4; 206/524.8

(56) References Cited

U.S. PATENT DOCUMENTS

| | | | | |
|---|---|---|---|---|
| 4,335,559 | * | 6/1982 | Nausedas | 53/138.4 |
| 4,709,819 | * | 12/1987 | Lattuada et al. | 206/524.8 |
| 5,822,951 | * | 10/1998 | Rosik | 53/432 |
| 6,018,932 | * | 2/2000 | Eberhardt, Jr. et al. | 53/432 |

* cited by examiner

*Primary Examiner*—Teresa Walberg
*Assistant Examiner*—Quang Van
(74) *Attorney, Agent, or Firm*—Fliesler Dubb Meyer & Lovejoy LLP

(57) ABSTRACT

A vacuum packaging apparatus is disclosed having a novel vacuum sensor system. The vacuum sensor system includes first and second sensors in communication with a control circuit, which sensors are provided to detect first and second preset vacuum levels as a container is being evacuated. The control circuit further includes a timer for measuring the elapsed time between detection of the first and second preset vacuum levels. The control circuit computes an additional time period necessary to reach a target vacuum level after reaching the second preset vacuum level by multiplying the elapsed time between the first and second preset vacuum levels by an algorithmic factor stored in the control circuit. The algorithmic factor is a numerical constant that is derived for a particular pump type, and is based on the pump characteristics and selected values for the first and second preset vacuum levels and the target vacuum level. The control of the vacuum level is self regulating, and compensates for atmospheric conditions, altitudes or pumping capacities.

11 Claims, 10 Drawing Sheets

VOLUMETRIC VACUUM CONTROL

BACKGROUND OF THE INVENTION

1. Field of the Invention:

The present invention generally relates to a device for vacuum sealing various containers including plastic bags and canisters, and in particular to a device including a vacuum sensor system for sensing and controlling the evacuation of fluid from a container to a predetermined pressure independent of surrounding atmospheric conditions or container size.

2. Description of Related Art:

Various systems and methods are known for the purpose of vacuum sealing containers to protect perishables provided therein against oxidation. As oxygen is a main cause of food spoilage, removing the air that surrounds foodstuff inhibits growth of bacteria, mold, and yeast. In this regard, vacuum sealed foods often last three to five times longer than normal refrigerated food stored in ordinary containers. Moreover, vacuum sealing is useful for storing all kinds of items such as clothes, photographs or silver in order to prevent discoloration, corroding, rust, and tarnishing. Vacuum sealing also results in tight, strong and compact packages thereby reducing the bulk of supplies and allowing for more space to store food or other articles. Furthermore, vacuum sealing minimizes odors which may spread to other stored items, and also acts to prevent freezer bum.

One type of vacuum sealing system, primarily used for commercial packaging purposes, includes a vacuum chamber in which the entire packaged product is placed, along with heat sealers for sealing the package once a vacuum has been substantially established within the interior of the package. Conventional devices of this type tend to be large, expensive, and stationarily mounted such that the containers to be sealed must be brought to the vacuum packaging device.

Still another type of conventional vacuum sealing system is manufactured to be more compact and economical for home use. One such system is disclosed in applicant's U.S. Pat. No. 4,941,310, entitled, "APPARATUS FOR VACUUM SEALING PLASTIC BAGS", which in one embodiment discloses a vacuum chamber including an opening defined by a stationary support member and a moveable hood. An open end of a container such as a plastic bag to be sealed is received within the vacuum chamber between the support member and the moveable hood, such that when the hood is moved to a closed position, a sealed environment including the vacuum chamber and the interior of the plastic bag is established. A preferred type of bag for use with such a system is disclosed in applicant's U.S. Pat. No. 4,756,422, entitled, "PLASTIC BAG FOR VACUUM SEALING", which plastic bag is provided with a series of air channels on interior surfaces of the bag. The air channels prevent a front section of the bag (i.e., that proximate to the vacuum packaging device) from becoming sealed while there are still air pockets toward a rear of the bag.

After the moveable hood is located in the closed position with the open end of the plastic bag located within the vacuum chamber, a pump within the device evacuates the fluid from within the bag. Once a vacuum is substantially established within the bag, a heat source seals the opening of the bag thereby vacuum sealing the perishable goods within the bag. In order to seal canisters, U.S. Pat. No. 4,941,310 alternatively discloses a vacuum device including a plastic vacuum tube having a first end sealably connected to the vacuum chamber and a second end sealably connected to a canister having a lid customized to receive the second end of the vacuum tube. As in the embodiments of the device for evacuating plastic bags, once the device is turned on, air will be drawn from the canister through the tube by the evacuation pump, until the sensor system indicates that the proper evacuation pressure has been established within the cansiter.

In vacuum packaging devices, it is desirable to evacuate the air from within a container (plastic bag or canister) down to a controlled and repeatable target shutoff pressure, regardless of the surrounding atmospheric conditions. Conventional vacuum packaging devices for vacuum packaging perishable items such as those described above attempt to accomplish this manually or by having a control system turn off the evacuation pump when a vacuum sensor determines that the pressure within the container being evacuated reaches some target fraction of the surrounding atmospheric pressure. A problem with conventional systems, however, is that atmospheric pressure will vary significantly depending on weather conditions and the height above sea level. Consequently, the target shutoff pressure within the chamber will vary as well.

Variance in the desired target pressure presents problems in addition to the lack of precise control and repeatability. For example, if a control system were configured at sea level to shut off the evacuation pump when the pressure sensor measured a chamber pressure of 15% of atmospheric pressure, at higher elevations/low pressure conditions, the pump motor capacity may not be sufficient to evacuate the chamber to 15% of the low pressure surrounding atmosphere. In such an instance, the pressure within the chamber would never reach the fractional target pressure, and the control system would never send the shutoff signal to the pump motor. This would be true even though the absolute pressure within the chamber may have reached or exceeded the intended vacuum packaging level.

The above-described problem may be solved by providing a conservative pump shutoff point, one where the chamber pressure reaches a somewhat larger fraction of the surrounding atmospheric pressure (e.g., 25% of atmospheric). However, this solution presents another problem in that, at lower elevations/higher pressures, the target pressure will be reached when there is still a relatively large amount of air remaining in the chamber. This may provide poor food storage conditions and largely negate the advantages of vacuum packaging.

Many solutions have been offered to deal with the variance in atmospheric pressures at different elevations. A vacuum packaging device is known where a user makes adjustments to the device depending on the surrounding atmospheric pressure. However, this design is not practical or user-friendly because the device would require the user to make frequent adjustments to the reference pressure to operate reliably. Moreover, the precision of these devices depends in part on the user's knowledge of the atmospheric conditions in the area in which the vacuum packaging device is being used. Precise information in this regard is not often readily available.

Another problem with conventional vacuum sealing systems is that such systems typically utilize sensors that measure pressure only indirectly. For example, in U.S. Pat. No. 5,195,427, entitled, "SUCTION DEVICE TO CREATE A VACUUM IN CONTAINERS", the vacuum packaging apparatus includes a pump for evacuating the container, a motor for driving the pump and an electronic vacuum sensor which senses the formation of a vacuum within the container based on the increase in current drawn by the motor. The shortcoming to such an apparatus is that the current drawn will not only depend on the pressure within the container, but also on pump and motor characteristics, which may vary from pump to pump and motor to motor. For example, at low pressures within the container, leakage may occur in the pump, which will result in a different current draw from the motor than should be indicated for the low pressure within the container.

A still further problem found in conventional vacuum packaging systems is that such systems attempt to measure pressure at the target shutoff pressure and near the pump's performance limits, which measurement governs whether or not the pump gets shut off. For various reasons in addition to those described above relating to operation at low ambient pressures, the sensor may never sense the shutoff pressure. For example, the pump may be old or otherwise not operating to its specifications, or there may be a small leak in the container. In these instances, the target shutoff pressure would never be reached and the pump would continue to run.

SUMMARY OF THE INVENTION

It is therefore an advantage of the present invention to provide a vacuum sensor system for use within a vacuum packaging apparatus for indicating the formation of a vacuum within a vacuum-sealed container independently of the surrounding atmospheric pressure.

It is a further advantage of the present invention to provide a vacuum sensor system for use within a vacuum packaging apparatus which allows for volumetric vacuum control which is self-regulating.

It is yet a further advantage of the present invention to provide a vacuum sensor system which avoids problems with typical sensors which occur when attempting to take pressure readings at low atmospheric pressures.

It is another advantage of the present invention that the pump shut down is not dependent on a sensor reading a pressure at or near the target vacuum level.

It is another advantage of the present invention to provide a vacuum sensor system for use within a vacuum packaging apparatus which may be easily incorporated into existing vacuum packaging apparatus designs.

It is still a further advantage of the present invention to provide an improved vacuum sensor system which is simple and efficient to use.

It is another advantage of the present invention to provide a vacuum sensor system which avoids the problems found in the prior art where operating near the pump's performance limits.

These and other advantages are provided by the present invention, which in preferred embodiments relates to a vacuum packaging apparatus including an improved vacuum sensor system for achieving controlled evacuation of a container, such as a plastic bag or canister, at various atmospheric conditions and altitudes. In preferred embodiments, the vacuum sensor system is included as part of the vacuum packaging apparatus having a stationary base member and a pivotable hood which together define a composite vacuum chamber therein.

The vacuum sensor system according to the present invention comprises first and second sensors in communication with a control circuit. The first and second sensors are provided within the vacuum packaging apparatus for sensing the formation of a vacuum within the container, and in particular, the first sensor is set to detect a first preset vacuum level and the second sensor is set to detect a second preset vacuum level. As indicated in the Background of the Invention section, erroneous readings are more prone to occur at low chamber pressures that approach the limits of the sensor and/or pump. In accordance with the present invention therefore, the first and second preset vacuum levels are preferably set well above target vacuum so that the readings are taken well within the limits of the pump and sensor performance.

In operation, the evacuation of a container is initiated by closing the hood of the vacuum packaging device and activating a start button. The start button will activate a motor which in turn drives a pump to begin evacuation of the vacuum chamber and container in communication therewith (either bag or canister). When the pressure in the container reaches the first preset vacuum level, the first sensor sends a signal to the control circuit. The control circuit then starts a timer which measures the passage of time until the pressure in the container reaches the second preset vacuum level. The control circuit computes the additional time period necessary after reaching the second preset vacuum level by multiplying the elapsed time between the first and second preset vacuum levels by an algorithmic factor stored in the control circuit. The algorithmic factor is a numerical constant that is derived for a particular pump model, and is based on the pump characteristics and selected values for the first and second preset vacuum levels and the target vacuum level. The target vacuum level is a predetermined minimum pressure/maximum vacuum level measured at sea level. Upon passage of the remaining time period, the control circuit shuts down the pump motor and evacuation of the container stops. For plastic bags, the additional step of heat sealing the plastic bag is then performed.

For larger containers, the time it takes to reach the first preset vacuum level, as well as the time between the first and second pressure levels, will be greater in comparison to that for smaller containers. Accordingly, the calculated time period remaining to the target vacuum level after reaching the second preset vacuum level will be longer for larger containers than for smaller containers. More significantly, according to the present invention, the time between the first and second preset vacuum levels will vary at different external pressure conditions. For example, at high altitudes/low ambient pressures, the time it takes for a given pump to reach the first preset vacuum level, as well as the time between the first and second pressure levels, will be greater in comparison to the same pump operating at low altitudes/high ambient pressures. Accordingly, at higher altitudes, the computed time period remaining after reaching the second preset vacuum level will be longer than for lower altitudes. The end result is that the control circuit will shut down the pump when the desired target vacuum level within the container is reached or surpassed. While the atmospheric pressure will affect the length of time the control circuit runs the pump, the pressure at which the pump shuts down will be the target vacuum level at sea level, or lower than target vacuum level when the device is used in higher altitudes, but will never be above the target vacuum level.

Another advantage of the present invention is that preset vacuum level readings are taken by the two pressure sensors at pressures well above target vacuum. Thereafter, no further pressure readings are taken. After the first and second pressure readings have been taken, the pump is run for some additional calculated time period and is then simply shut down by the control circuit. As such, the problems found in the prior art of attempting to take pressure readings at or near the target vacuum level are avoided.

BRIEF DESCRIPTION OF THE DRAWINGS

The present invention will now be described with reference to the drawings, in which.

DETAILED DESCRIPTION

The invention will now be described with reference to FIGS. 1 through 10 which in general relate to a vacuum sensor system for use within a vacuum packaging apparatus for vacuum sealing a container. As used herein, the term "container" refers to any of various receptacles, including any of various sealable bags and any of variously shaped canisters. It is further understood that the vacuum sensor system according to the present invention may be used with vacuum packaging apparatus of various designs including both vacuum packaging apparatus for industrial or home usage.

Figure 6:
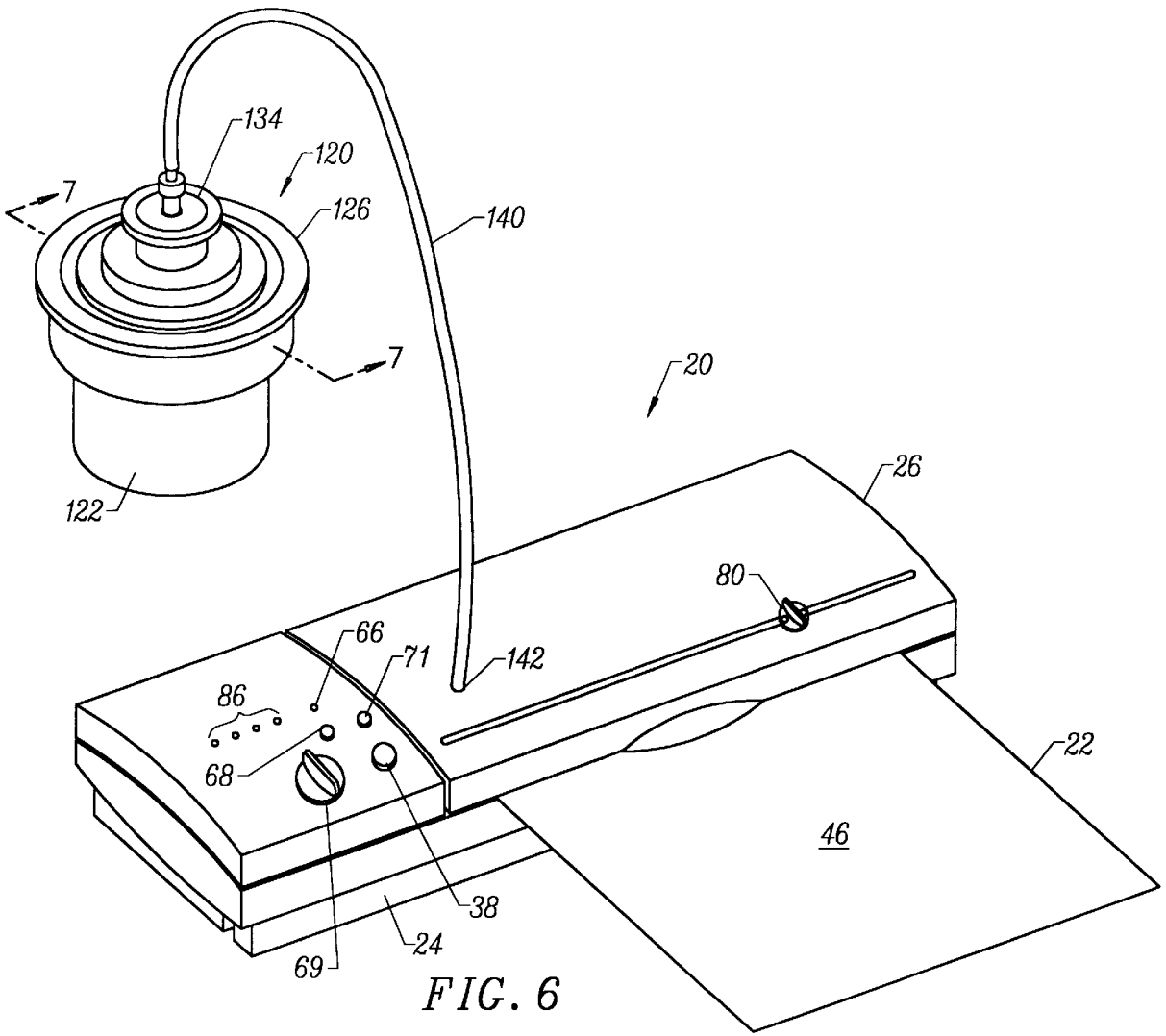
FIG. 6 is a perspective view of the vacuum packaging device including a lid attachment for evacuating a non-elastic canister.
Figure 7:
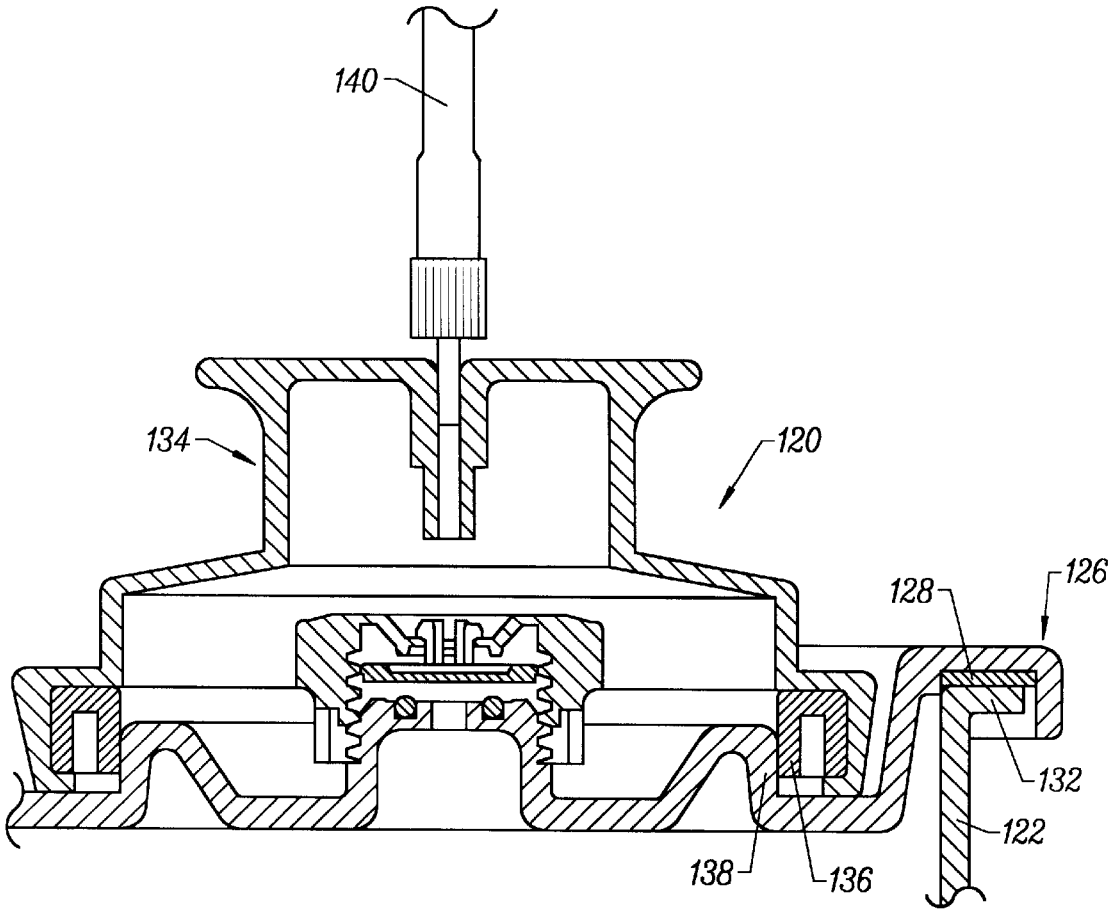
FIG. 7 is a cross-sectional side view of the lid attachment taken through line 7—7 of FIG. 6.

FIGS. 1–4 illustrate a vacuum packaging apparatus 20 for evacuating and sealing a vacuum-seal container. The vacuum-seal container may comprise a heat sealable plastic bag 22 such as that taught in U.S. Pat. No. 4,756,422, entitled, "PLASTIC BAG FOR VACUUM SEALING", which patent is assigned to the owner of the present invention and which patent is incorporated by reference herein in its entirety. In particular, the plastic bag 22 comprises overlying first and second panels which are closed on three sides to define an open end. The open end is for insertion of food, liquids or other objects. It is understood that the plastic bag 22 can be formed as an individual bag or from a continuous bag roll. It is also understood that the container to be vacuum sealed may be a canister having a cover including a valve specially adapted for use with the present invention, as shown in FIGS. 6 and 7 and as explained hereinafter.

Referring still to FIGS. 1–4, the vacuum packaging apparatus 20 includes a stationary base member 24 and a pivotable hood 26 which together define a composite vacuum chamber 28 (FIG. 4) therein, as explained hereinafter. The apparatus further includes a section 26*a* adjacent to hood 26, which section 26*a* includes external control buttons, knobs and indicators for operating the apparatus 20 as explained hereinafter. The base member 24 includes a lower trough 30 (FIGS. 3 and 4) which forms a bottom portion of the vacuum chamber 28 within which the opening of a bag 22 may be received.

Figure 1:
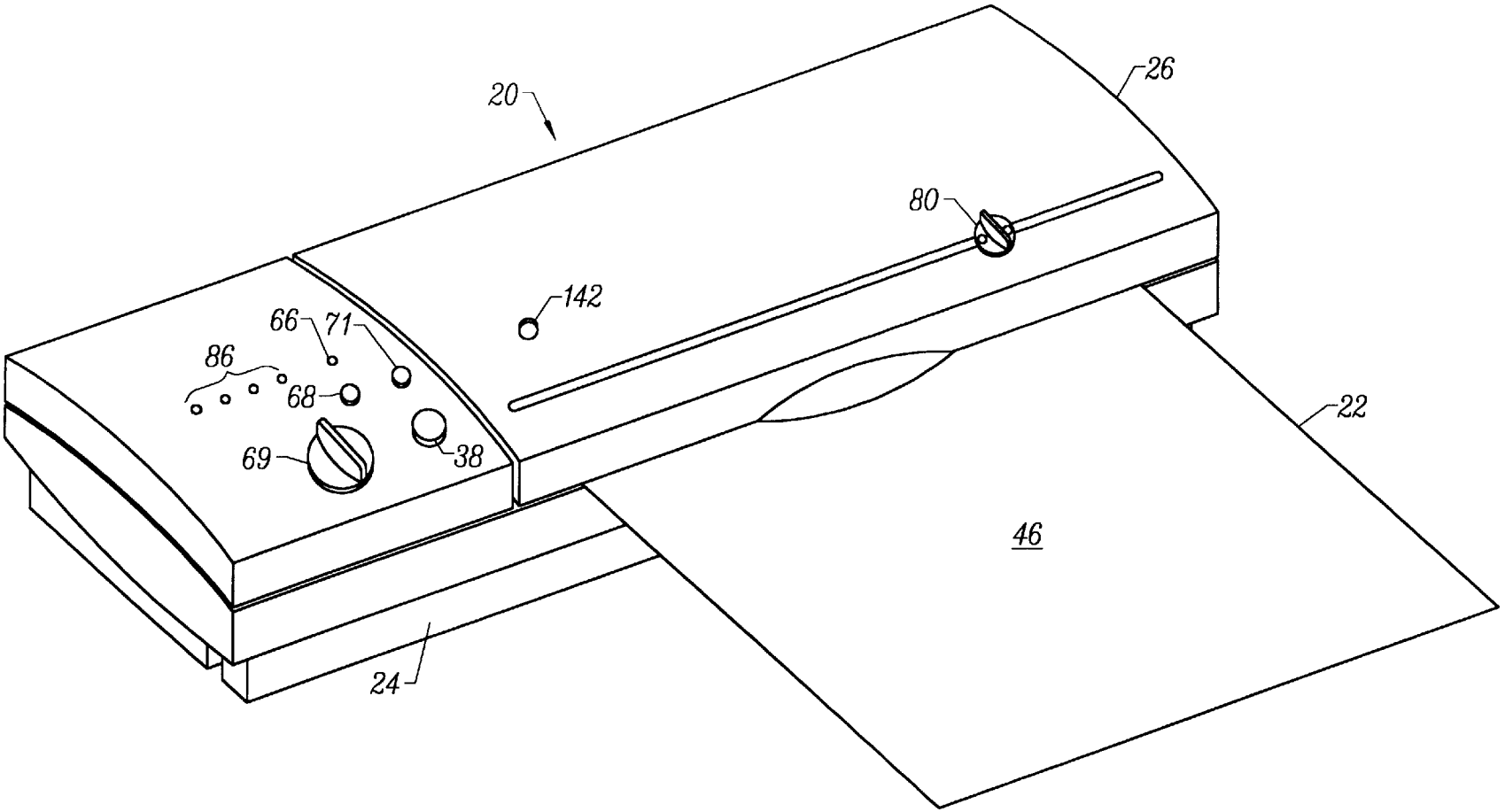
FIG. 1 is a perspective view of a vacuum packaging apparatus according to the present invention.

The pivotable hood 26 is movable between a first, open position (FIG. 3) and a second, closed position (FIG. 1). The pivotable hood 26 includes hooks 32 (FIG. 2) on each side of the hood for securing the hood in the closed position. The hooks 32 engage cams 34 located in the base member 24, which cams rotate to pull down hood 26 once an on button 38 is pressed. Cams are driven by a stepper motor 39. The pivotable hood 26 also includes an upper trough 36 (FIGS. 2 and 4) which forms a top portion of the vacuum chamber 28 and which overlies the lower trough 30 as explained below. On completion of the evacuation process, the hood 26 automatically opens allowing the plastic bag 22 to be removed. The vacuum sealing process may be interrupted and/or terminated after formation of only a partial vacuum within the container by activation of the button 38 in the section 26*a*. The hood may also be automatically lowered to its closed position using an electrically or pneumatically activated mechanism for hands-off operation or may include various additional standard control devices such as a remote control, to enhance the versatility and ease of operation of the apparatus.

The vacuum chamber 28 (FIG. 4) is formed by the lower trough 30 and the upper trough 36 and extends longitudinally substantially a full length of the base member 24 and pivotable hood 26, respectively. A sealing gasket is further provided around the vacuum chamber, which sealing gasket is formed by an upper elastomeric member 42 (FIGS. 2 and 4) suitably secured to the hood, surrounding the upper trough 36, and a lower elastomeric member 44 (FIGS. 2 through 4) suitably secured to the base member 24, surrounding the lower trough 30.

Figure 4:
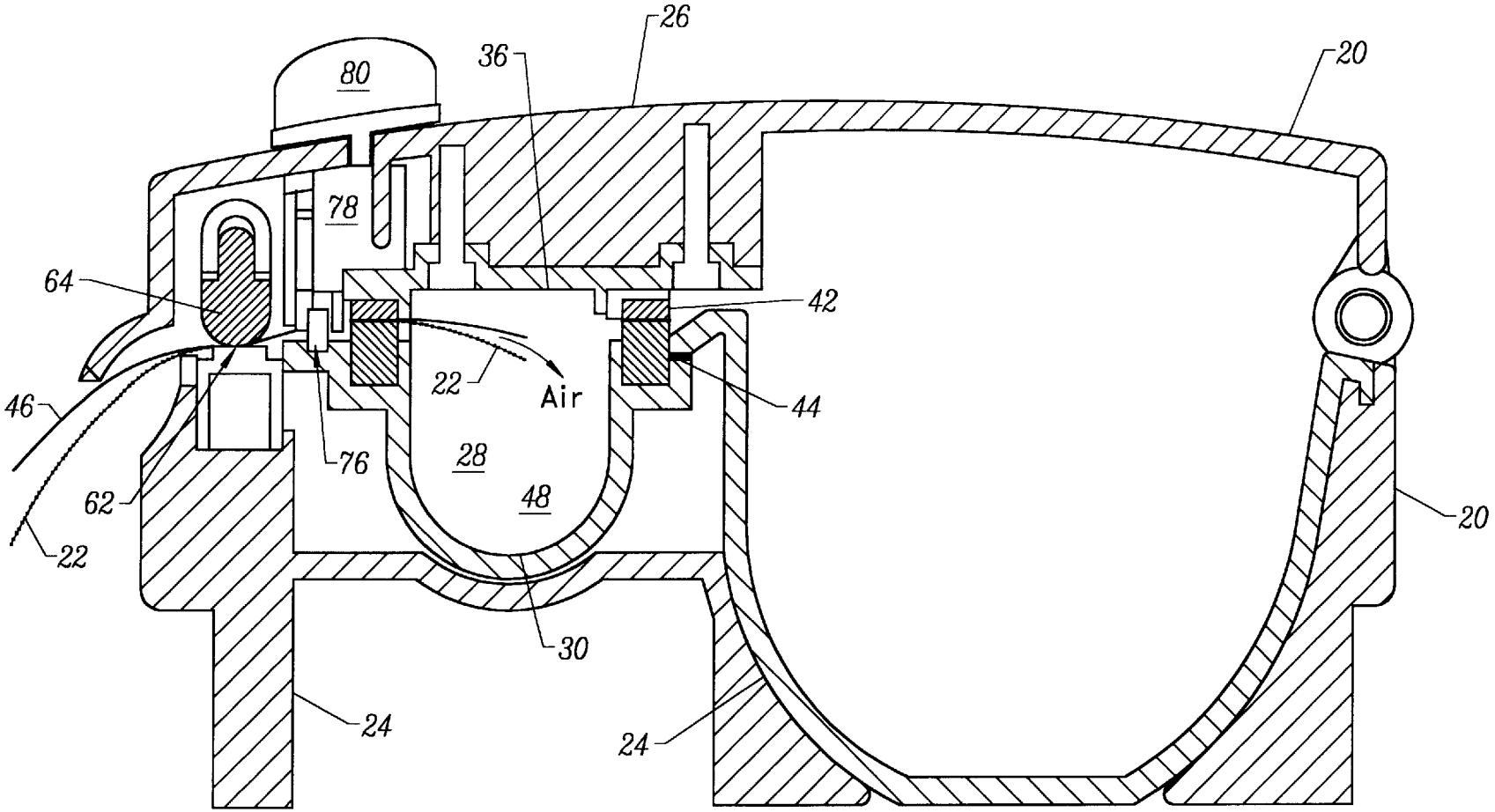
FIG. 4 is a cross-sectional side view of the vacuum packaging apparatus according to the present invention.

As seen in FIG. 4, when the hood 26 is in the closed position, the sealing gasket creates a sealed environment isolating the open end and an interior 46 of the plastic bag 22, and the vacuum chamber 28 from the surrounding environment. Thereafter, fluid may be evacuated from the interior 46 of the plastic bag 22 and the interior 48 of the vacuum chamber 28. As shown in the exploded view of FIG. 2, fluid is drawn from the interiors 46, 48 through a line 50 by an evacuation pump 52 in communication with the vacuum chamber 28. Line 50 is also connected to the sensor system 58 (explained hereinafter) so that the sensor system sees the same pressure as that within the interiors 46 and 48 during evacuation by the pump 52. The pump is controlled by a control circuit 54 as will be hereinafter explained in greater detail. The fluid drawn from the interiors 46, 48 is thereafter expelled out of an exhaust port 56 into the surrounding environment. Evacuation pump 52 is preferably a conventional mechanical pump including a piston 53 reciprocated by a motor 55, which piston reciprocation expels fluid from the sealed environment in short, rapid pulses. Evacuation pumps and drive mechanisms of this type are well known in the art, and further detailed description thereof is deemed unnecessary for a full understanding of the present invention. It is also understood that other types of pumps may be used dependent upon the size and operating characteristics of typical commercially available pumps. Moreover, the motor may be connected to the pump in any suitable manner.

The evacuation pump 52 continues evacuation of the fluid from the interiors 46, 48 of the plastic bag 22 and vacuum chamber 28 until a vacuum sensor system 58 according to the present invention indicates that a vacuum has been substantially established to a predetermined vacuum level as will be described in greater detail below. Thereafter, the overall control circuit 54 turns off the pump and automatically activates a heat sealer mechanism 60 to thereby create an air-tight seal across the open end of the plastic bag 22.

Figure 2:
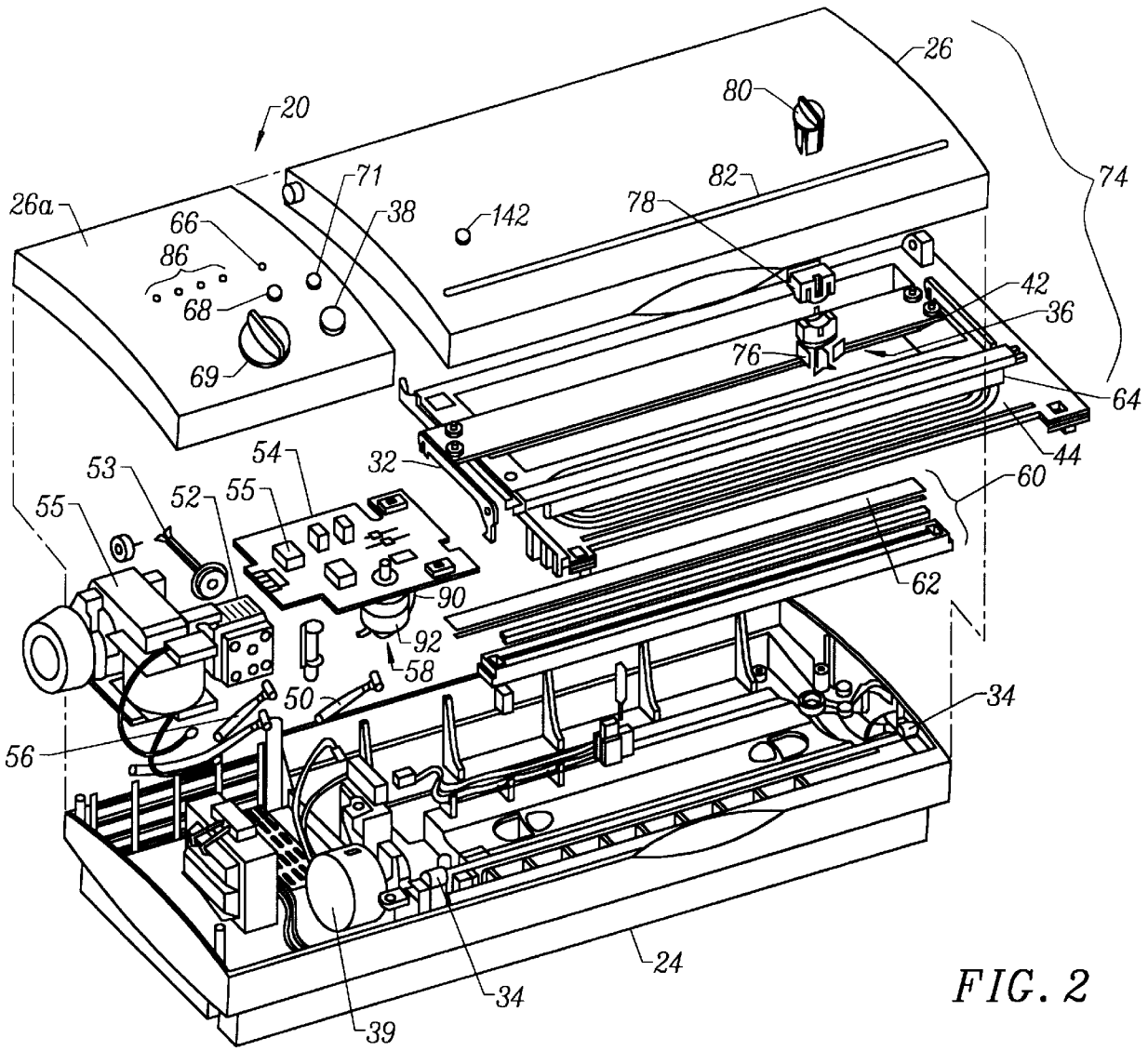
FIG. 2 is an exploded view of the vacuum packaging apparatus according to the present invention.
Figure 3:
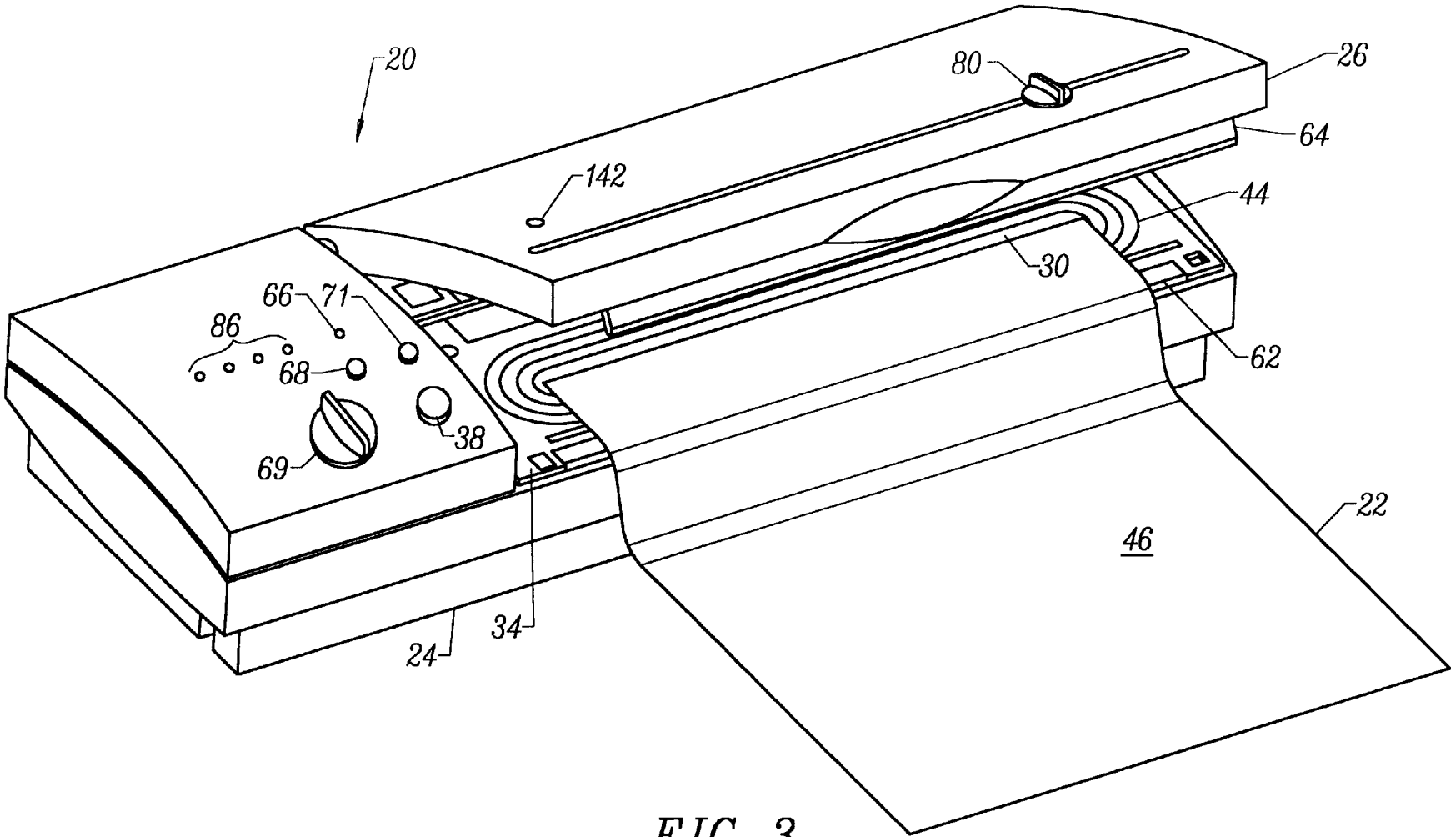
FIG. 3 is a perspective view of the vacuum packaging apparatus showing a hood in a partially open position according to the present invention.

With reference to FIGS. 2 and 3, the heat sealer mechanism 60 comprises a low voltage heating element 62 located in front of the lower trough 30 on the base member 24 and a pressure profile 64 located in front of the upper trough 36 on an underside of the hood 26 of the vacuum packaging apparatus 20. The heating element 62 extends substantially the full length of the base member 24 and past the ends of the vacuum chamber 28 to ensure full sealing across the full width of the plastic bag 22 when draped over the heating element 62. When the heating element 62 is activated, the overlying panels at the open end of the plastic bag 22 are sealed together via heat conduction through the layers. The heating element, as well as the other electrical and electronic components of the present invention, may be powered by a conventional power source and/or converter. In an alternative embodiment of the present invention, a bank of ultracapacitors may be used to power the heating strip as disclosed in U.S. patent application Ser. No. 09/022,613, entitled "PLASTIC BAG SEALING APPARATUS WITH AN ULTRACAPACITOR DISCHARGING POWER CIRCUIT", which application is assigned to the owner of the present invention, and which application is hereby incorporated by reference herein in its entirety. A Teflon tape may also be secured over the heating element to prevent adherence of the plastic bag thereto.

As shown in FIGS. 3–4, the pressure profile 64 longitudinally extends the full length of the underside of the hood 26 and past the ends of the vacuum chamber 28. The pressure profile 64 overlies the heating element 62 when the hood is in the closed position and ensures that adequate pressure is exerted on the plastic bag while heat is applied to the bag by element 62 to facilitate a secure and uniform sealing of the bag. A heat sealing indicator 66 comprising a light mounted on section 26*a* is energized to indicate to the operator activation of the heating element 62. A manual button 68 may also be provided on the section 26*a* for manually initiating the heating assembly to seal the plastic bag 22 for situations where the operator desires to seal the plastic bag before automatic activation of the heat sealer mechanism by the control circuit, for example, in situations where it is desired to seal the plastic bag before complete evacuation of the fluid has occurred. Section 26*a* may further include a seal timer knob 69 in communication with the control circuit and when the knob 69 is turned, bag sealing time can be adjusted up or down as required.

As depicted in FIG. 2, a knife assembly 74 is also located within and on top of the hood 26 for severing the plastic bag 22 from a continuous bag roll, or cutting off excess overlying panels of an individual bag after the plastic bag has been heat sealed. The knife assembly 74 comprises a cutting element 76, a slider 78 and a handle 80. The cutting element 76 is supported on the slider 78 and is in communication with the handle 80 located in an elongated slot 82 which extends therethrough in the hood 26. The operator, gripping the handle 80, slides the handle 80 across the slot 82 of the hood. This motion activates the cutting element 76 to engage the plastic bag 22 which remains secured in place by the pressure profile 64 and vacuum chamber 28. The knife assembly may also be automatically activated in alternative embodiments.

With reference now to FIG. 2, the control circuit 54 is provided to control the operation of the vacuum packaging apparatus 20. More specifically, the control circuit 54 comprises circuit elements which provide fully automated control of the pump motor 55, heat sealing assembly 60 and the various visual indicators in the hood. The control circuit also monitors and controls the vacuum sensor system 58 as explained below.

Referring to FIGS. 1–3, a vacuum indicator 86 is shown. The vacuum indicator 86 is located on the top of the section 26*a* and preferably shows a visual representation of the vacuum formation within the interiors 46, 48 of the plastic bag and vacuum chamber. The vacuum indicator 86 is in communication with the control circuit 54, and provides an indication of a diminishing flow from or volume within the plastic bag as the vacuum is formed. In particular, as explained hereinafter, the sensor system 58 is set to sense first and second preset vacuum levels. The four indicator lights in vacuum indicator 86 are used to indicate, respectively, the time at which pumping begins, the time at which the first preset vacuum level is detected, the time at which the second preset vacuum level is detected, and the time at which heat sealing of the bag begins. This allows a user of the vacuum packaging apparatus 20 to monitor the progress of the evacuation process carried out by the vacuum packaging apparatus. It is understood that various other vacuum indicators, as well as other visual indicators in general, may be used in accordance with the present invention. Examples of such other indicators are set forth in greater detail in U.S. Pat. No. 5,655,357, entitled, "EXHAUST FLOW RATE VACUUM SENSOR", which patent is assigned to the owner of the present application and which patent is incorporated by reference herein in its entirety. Additionally, it is understood that the various buttons, knobs and indicators included on section 26*a* are not critical to the present invention, and various alternative configurations are contemplated.

With reference now to FIG. 2, the vacuum sensor system 58 comprises a first sensor 90 and a second sensor 92 in communication with the control circuit 54. The first sensor 90 and the second sensor 92 are provided within the vacuum packaging apparatus 20 for sensing the formation of a vacuum within the vacuum chamber 28 and container. The first sensor 90 is set to detect a first preset vacuum level and the second sensor 92 is set to detect a second preset vacuum level.

In a preferred embodiments the first preset vacuum level may range between 10% and 20% below ambient, and the second preset vacuum level may range between 30% and 40% below ambient. It is understood however that these levels are by way of example only and may vary in alternative embodiments. It is also contemplated that the first preset vacuum level be set at or near ambient pressure in an alternative embodiment not used for evacuating bags (as is explained hereinafter).

Various pressure sensors may be used in accordance with the present invention. Two embodiments of such a pressure sensor are disclosed in U.S. Pat. No. 5,765,608, entitled "HAND HELD VACUUM DEVICE", which patent is assigned to the owner of the present application and which patent is incorporated by reference herein in its entirety. A preferred embodiment disclosed therein comprises a double-throw pressure switch which can be set to trip when the pressure within the container and vacuum chamber is some preset percentage of ambient. As such, the preset point at which each of the sensors will trip will vary with a variance in the ambient pressure. However, as explained hereinafter the system of the present invention accommodates for variations in ambient pressure so that a container is evacuated to or beyond a repeatable target vacuum level with each use.

Figure 5:
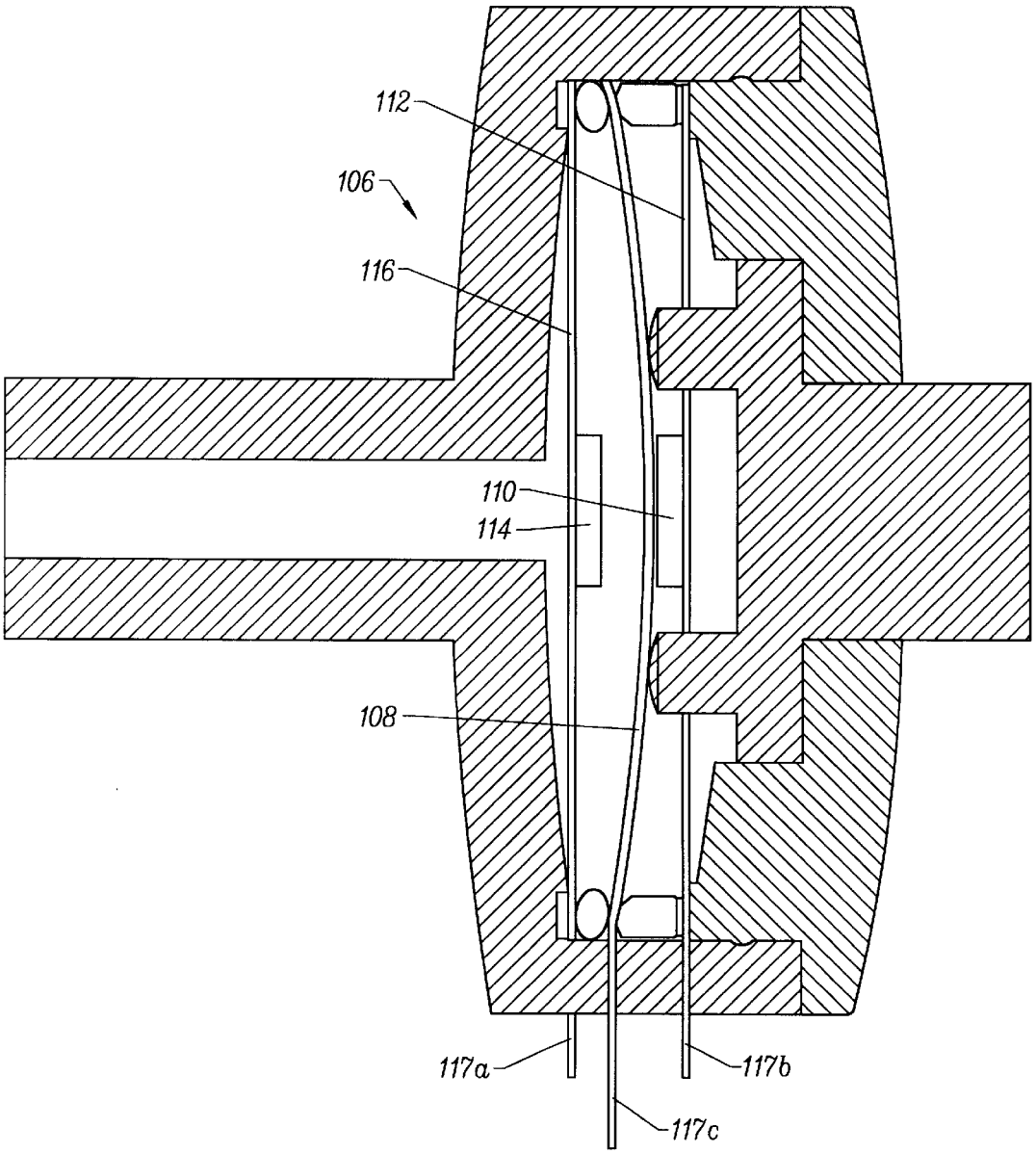
FIG. 5 is a cross-sectional side view of an embodiment of a vacuum sensor for use with the vacuum sensor system according to the present invention.

An example of double-throw pressure switches 90, 92 is shown in FIG. 5. Each sensor comprises a flexible, elastic contact membrane 108 which moves between two positions. In a first position, the contact membrane 108 lies in contact with a contact point 110 which is electrically and physically coupled to a first contact plate 112. In a second position (not shown), the contact membrane 108 lies in contact with a contact point 114 which is electrically and physically coupled to a second contact plate 116. Contact membrane 108 and contact plates 112, 116 are electrically conductive and are electrically coupled to leads 117*a–c*. Leads 117*a–c* may in turn be electrically coupled to the control circuit 54 or other electrical components. In a preferred embodiment, the membrane and the contact plates may be substantially circular from a top perspective. However, the shape of the membrane and the contact plates may vary in alternative embodiments.

The contact membrane 108 is formed with a dome-like shape having a curvilinear cross section so that a center of the membrane bows outward into contact with the contact point 110 on the first contact plate 112. The membrane may be biased into the first position by a spring (not shown) and/or from an inherent bias resulting from the shape of the membrane. The contact membrane is an elastic component such that, upon application of a force to the membrane, the dome-like shape may invert so that the center of the membrane bows outward into contact with the contact point 114 on the second contact plate 116 and then return to the first position upon removal of the force.

A first side of the membrane 108 is open to ambient pressure and a second side of the membrane 108 is open to the container and evacuation chamber pressure. Once the motor 55 is switched on and evacuation of the container begins, the pressure on the container/evacuation chamber side of the membrane will decrease. Once the pressure within the container and vacuum chamber reach the first preset vacuum level, the pressure differential on opposite sides of the membrane will create a resultant force on the contact membrane 108 sufficient to overcome the inherent bias of the membrane into the first position. At this point, the membrane will switch from the first position in contact with the first contact plate 112 into the second position in contact with the second contact plate 116, which in turn sends a signal to the control circuit to indicate that the first sensor 90 has reached the first preset vacuum level.

The second sensor 92 is identical to the first sensor 90, with the exception that, in comparison to the first sensor, the membrane 108 of the second sensor requires a greater pressure differential on its opposed sides before it flips from the first to the second positions. Thus, the second sensor is capable of detecting a second preset vacuum level that is controllably lower than the first. As would be appreciated by one skilled in the art, the pressure differential at which the contact membranes of the respective pressure sensors 90, 92 switch from the first position to the second position may be controlled by controlling the physical parameters of the membranes, such as for example their shape, thickness, rigidity, size, etc.

It is understood that other pressure sensors may be utilized in place of a double-throw type pressure switch in alternative embodiments. For example, U.S. Pat. No. 5,765,608, previously incorporated by reference herein, further discloses a piezoelectric flow rate sensor that may be used for the sensors 90 and 92.

The control circuit 54 includes a timer 55 of known construction (shown schematically on FIG. 2). Once the first preset vacuum level has been detected by the first pressure sensor 90, the sensor 90 generates and sends a signal to the control circuit. The timer then begins a counter sequence to measure the time until the second preset vacuum level is detected by the second pressure sensor 92. Upon detection of the second preset vacuum level by the second sensor 92, the sensor 92 generates and sends a signal to the control circuit. The control circuit uses the elapsed time between detection of the first and second preset vacuum levels as measured by the timer to calculate an additional time period necessary for the pump to continue evacuating the container until the container and evacuation chamber reach the target vacuum level. After the additional calculated time period passes, the control circuit shuts down the pump.

The control circuit computes the additional time period necessary after reaching the second preset vacuum level by multiplying the elapsed time between the first and second preset vacuum levels by an algorithmic factor stored in the control circuit. The algorithmic factor is a numerical constant that is derived for a particular pump model, and is based on the pump characteristics and selected values for the first and second preset vacuum levels and the target vacuum level. Once the algorithmic factor has been experimentally determined for a pump and stored in the control circuit, this algorithmic factor is used to determine the pumping time necessary to evacuate a given container, regardless of the size of the container and regardless of the variations in the external ambient pressure. As explained below, variations in the size of a container and/or external ambient pressure will affect the elapsed time between the first and second preset vacuum levels, and consequently the computed additional pumping time necessary to evacuate the container. But the same algorithmic factor is used by the control circuit in each such computation.

The algorithmic factor may be calculated experimentally during a design phase of a vacuum packaging device according to the present invention, and then stored in the control circuit of each device including that type of pump during the manufacturing phase. Although not preferred, it is also contemplated that a separate calculation of the algorithmic factor could be done for each pump used. With reference to the graph of FIG. 8, in order to determine the algorithmic factor, a container of a given volume is evacuated from sea level pressure of approximately 1013 mb to its target vacuum level. The target vacuum level may vary in alternative embodiments but may for example be chosen as 200 mb. This is sufficiently low to provide proper vacuum packaging conditions within the container, but is safely above the maximum vacuum performance of typical pumps that may be used in the present invention. It is understood that the selected value for the target vacuum level may vary in alternative embodiments.

In this example, the first and second pressure sensors 90, 92 are configured to trip at 750 mb and 500 mb, respectively. As is shown on the graph, the volume of air within the container will decrease over time according to the plot labeled "A". Plot A shows that the pump takes approximately 5.75 seconds to go from the first preset vacuum level of 750 mb to the second preset vacuum level of 500 mb (as indicated by the pressure sensors), and then takes an additional 20.5 seconds to get from the second preset vacuum level to the target vacuum level of 200 mb. From this, the algorithmic factor, k, can be determined as:

$$k = 20.5 \text{ seconds} \div 5.75 \text{ seconds, or approximately } 3.6.$$

Figure 8:
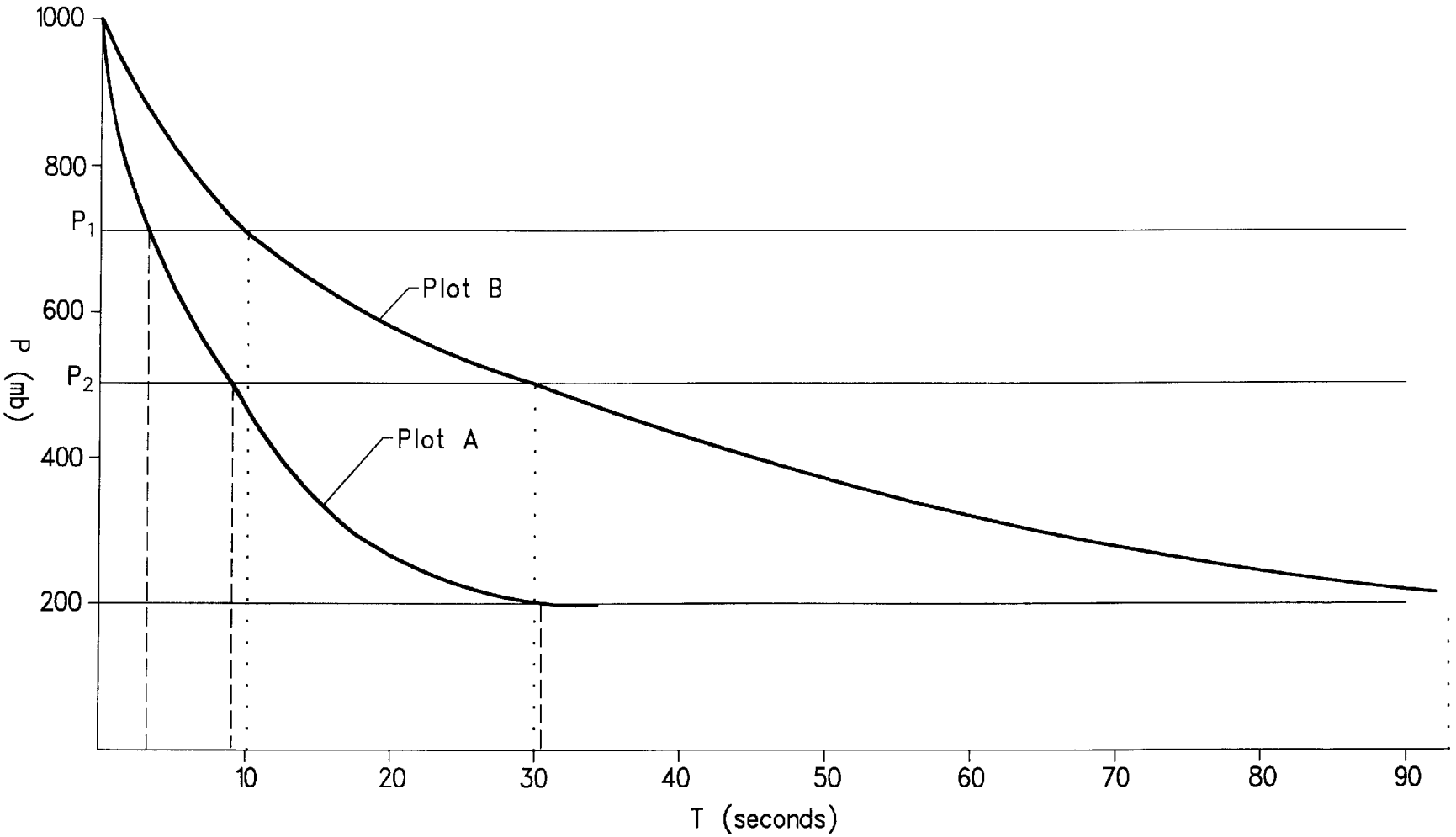
FIG. 8 is a graph of pressure versus time during the evacuation of two containers of differing volume.

Plot B on FIG. 8 shows the decrease in the volume of air in the second container over time. The second container is also evacuated at sea level, using the same first and second preset vacuum levels and same target vacuum level, but the second container is larger than the first container. As shown on plot B, it takes the pump about 18 seconds to go from the first to the second preset vacuum levels, and takes about 64 seconds to go from the second preset vacuum level to the target vacuum level. Thus, the value, k, of the algorithmic factor indicated by the evacuation of the second container is:

$k$=64 seconds÷18 seconds, or approximately 3.6.

In fact, it can be shown that the algorithmic factor will be substantially the same regardless of the size of the container to be evacuated. This follows from the fact that, within certain limits, the pump removes air from a container over time according to a fixed linear relationship (this is true for an inelastic canister, and, as explained in greater detail below, is true for a plastic bag once all of the "excess" air has been evacuated). This linear relationship will not vary with the size of the container or the external atmospheric pressure (at least within habitable elevations). The linearity derives from the fact that, in each instance a device according to the present invention evacuates a container, for any given time interval, the pump 52 removes the same fraction of air remaining in container with each successive passage of that time interval.

This linear relationship allows the algorithmic factor to be identified and used by the control circuit to compute the additional pumping time necessary to evacuate a container of a given volume to the target vacuum level. In particular, during the evacuation of a container, once the elapsed time between the first and second preset vacuum levels is measured by the timer, that elapsed time is multiplied by the stored algorithmic factor. That result is the additional time period the pump must be run from the time at which the second preset vacuum level is detected. Once the additional time period elapses as measured by the timer, the control circuit shuts off the pump.

As would be appreciated by those of skill in the art, other mathematical models may be used to describe the relationship between time and volume change to determine the additional pumping time from the elapsed time between the first and second preset vacuum levels. It is also understood that a non-linear relation between time and volume change may be developed in alternative embodiments, in which case the algorithmic factor would not be a simple constant, but would instead vary with time. It is also contemplated that the use of the algorithmic factor to determine pumping time may be overridden by a button 71 on the section 26*a* of the apparatus 20. In particular, the control circuit may be configured to run the pump for as long as the button 71 is depressed by an operator.

Figure 9:
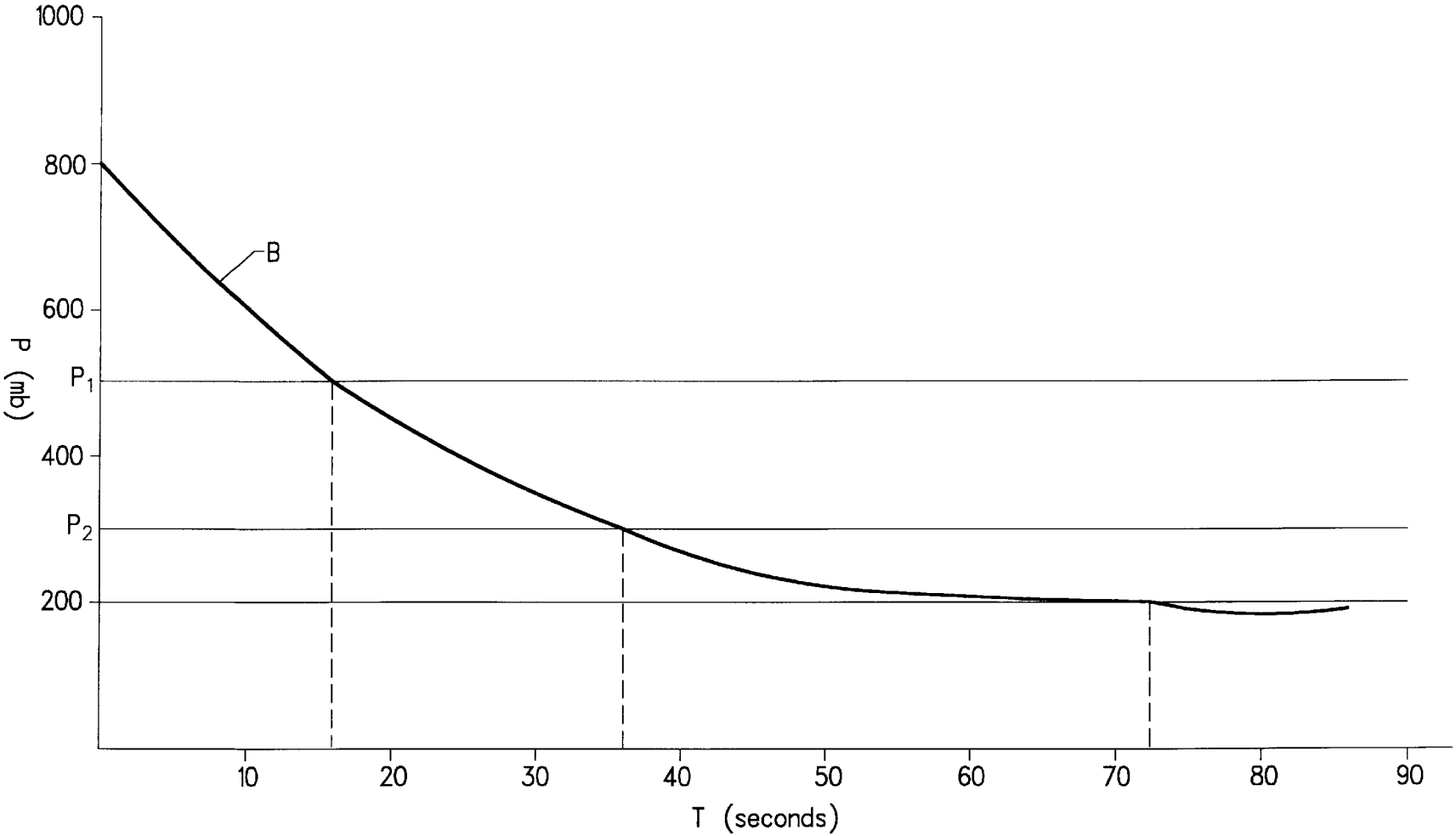
FIG. 9 is a graph of pressure versus time during the evacuation of a container at a reduced ambient pressure.

It is a further feature of the present invention that the same algorithmic factor may also be used as described above to evacuate a container to substantially the target vacuum level regardless of whether the vacuum packaging device is operated at sea level, high elevations or elevations in between. For example, FIG. 9 shows a plot C, which represents the evacuation over time of the same container that was used in plot A of FIG. 8. However, the container in FIG. 9 is being evacuated at a higher elevation, e.g., 5000 ft, where the ambient pressure is approximately 800 mb. As can be seen from Plot B on FIG. 9, it takes a longer period of time to evacuate the container at the higher elevation as compared to the same container at the lower elevation. This is true because, at higher elevations, the pump works less efficiently, i.e., the pump is not able to remove as much air during a single piston stroke as compared to the pump working at lower elevations.

Figure 10:
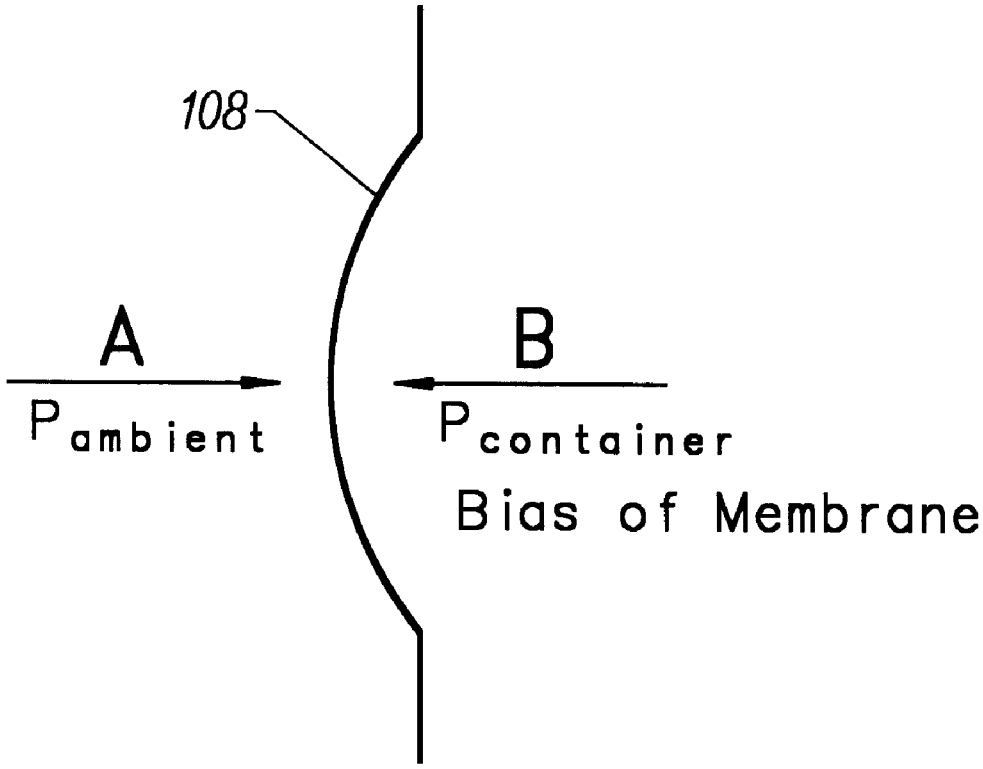
FIG. 10 is a schematic representation of the forces acting on a membrane of a sensor used to detect a preset vacuum level.

As described above, the additional pumping time is computed by the control circuit by multiplying the stored algorithmic factor by the elapsed time between the first and second preset vacuum levels as indicated by sensors 90 and 92. It is worth noting that at higher elevations, the sensors 90 and 92 will not trigger at the same preset vacuum levels as they do at sea level. This is illustrated in FIG. 10. As previously explained, a typical pressure sensor for use with the present invention includes a membrane 108. Ambient pressure exerts a force in the direction of arrow A on the membrane, and the pressure within the container, together with the spring or inherent bias of the membrane, exert a force in the direction of arrow B on the membrane. As can be seen, where the ambient pressure decreases, as at higher elevations, the pressure within the container at which the membrane flips will also decrease. Therefore, even though the first sensor is set to trip at for example 750 mb at sea level, it will trip at approximately 550 mb when used in an ambient pressure of 800 mb. Similarly, if the second sensor is set to trip at 500 mb at sea level, it will trip at approximately 300 mb when used in an ambient pressure of 800 mb.

Therefore, referring again to FIG. 9, the timer measures an elapsed time of approximately 20 seconds between the tripping of sensor 90 (at 550 mb) and the sensor 92 (at 300 mb). Using the same algorithmic factor of 3.6, the control circuit computes an additional pumping time of 20 seconds× 3.6, or 72 seconds As shown on FIG. 9, pumping for an additional 72 seconds after the second sensor 92 trips will evacuate the container approximately to the target vacuum level of 200 mb (in fact, the pump will have evacuated the container to a slightly lower pressure than the 200 mb target owing to the fact that the pump is exhausting against a reduced atmospheric pressure. However, this difference is negligible and well above the maximum vacuum performance limit for the pump).

As explained in the Background of the Invention section, conventional vacuum packaging systems are designed to extract air to vacuum levels close to the pump's performance limit, and use sensors that measure pressure at or near their target vacuum level in order to detect when to shut off the pump. However, when attempting to take such pressure readings at high vacuum levels, sensor limitations in typical sensors may adversely affect the accuracy of the reading. This problem is avoided in the present invention, where sensor readings are taken well above vacuum levels. Thus, relatively simple and cost efficient sensors may be used.

Additionally, it is a problem with conventional systems that, unless the sensor registered that the target vacuum level had been reached, the pump would never shut down. This could occur for example where the pump was old or otherwise not performing to specification; where there was a small leak in the container; or where the vacuum packaging device was used at high elevations. This is not possible with the present invention, where the pump will always automatically shut off after passage of the computed additional time period. Further still, most conventional vacuum packaging machines are accurate only at sea level, or require complicated adjustments to work properly at different ambient pressures. The system according to the present invention operates to evacuate a container to the target vacuum level substantially independent of atmospheric pressures and container sizes.

The invention has been described thus far as including two separate sensors for sensing the first and second preset vacuum levels. However, as would be appreciated by those of skill in the art, the sensor system 58 may employ a single sensor for sensing two different preset vacuum levels in an alternative embodiment. In a further alternative embodiment used to evacuate canisters, it is additionally contemplated that one or two sensors may be used to take two pressure readings at a first preset time and a second preset time. In such an embodiment, the control circuit 54 may use the pressure difference and the elapsed time to calculate the time required to evacuate the container to the predetermined target vacuum level as previously described.

It is also contemplated that a single sensor could be used, with the sensor set to detect the second preset vacuum level. In this embodiment, the system uses ambient pressure at sea level as the first preset vacuum level. The control circuit measures the time from when the pump starts operating to the time when the single sensor measures the second preset vacuum level. This elapsed time is then multiplied by the algorithmic factor to yield the additional time period.

This embodiment is not preferred for evacuating plastic bags, as the evacuation profile for plastic bags does not follow the linear model until all of the excess air is evacuated from the bag. Thereafter, the plastic bag becomes substantially inelastic, and the pumping profile will thereafter conform to the linear model described above (although the air will generally be evacuated more quickly as compared to a canister). Where the first preset vacuum level is set at value below ambient, as in the preferred embodiment, this allows the pump time to evacuate the excess air in the bag so that the evacuation profile follows the linear model at least at the time when the first preset vacuum level is reached.

As depicted in FIGS. 6 and 7, in order to evacuate a canister, the vacuum packaging apparatus 20 may include a lid attachment 120 for a canister 122 which is adapted for connecting the canister 122 to the vacuum packaging apparatus 20. The lid attachment 120 comprises an annular lid adapter 126 and an annular elastomeric seal 128 secured thereunder to form a static seal at an upper flange 132 of the non-elastic canister 122. The lid attachment 120 further comprises an annular connector 134 having an annular elastomeric seal 136 secured thereunder to engage a radially outer surface of an annular ridge 138 formed on the lid adapter 126. A flexible plastic tube 140 is attached between the annular connector 134 and an opening 142 (FIGS. 1 and 6), formed through the top panel of the hood 26. The operator initiates the evacuation process by depressing the button 38. Once evacuation begins, the vacuum sensor system 58 allows for controlled evacuation in the same manner as previously discussed above.

It is understood that the features of the present invention may be incorporated into a hand held device vacuum which engages with a canister for the purpose of evacuating fluid from the canister. Details relating to a hand held vacuum device are disclosed in the above-referenced U.S. Pat. No. 5,765,608. The vacuum sensor system explained above may be provided within the device for sensing the formation of a vacuum within the canister and for indicating when a vacuum has been substantially formed within the canister.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

What is claimed is:

1. A control system in a vacuum packaging apparatus including a pump, the control system provided at least for controlling an evacuation of a container associated with the vacuum packaging apparatus to a target vacuum level, the control system comprising:

means for measuring a first time between a first vacuum level and a second vacuum level as the pump evacuates the container;

an algorithmic factor, a value of said algorithmic factor being dependent at least on said first vacuum level, said second vacuum level and said target vacuum level; and means for computing a second time for which the pump must be run after the first vacuum level to reach the target vacuum level, said computing means using said first time and said stored algorithmic factor.

2. A vacuum sensor system for use with a vacuum packaging device including a pump for evacuating a container under prevailing atmospheric conditions, comprising:

means for sensing a first preset vacuum level of the container and sending a first signal;

means for sensing a second preset vacuum level of the container and sending a second signal;

circuit means including a stored algorithmic factor and a timer means for determining an elapsed time period between said first and second preset vacuum level, said circuit means determining an additional time period for which the pump is to run to achieve a predetermined vacuum level in the container using said elapsed time period and said stored algorithmic factor.

3. The vacuum sensor system, as recited in claim 2, wherein said first preset vacuum level is set at 10–20% below ambient.

4. The vacuum sensor system, as recited in claim 2, wherein said second preset vacuum level is set at 30–40% below ambient.

5. An apparatus for vacuum sealing a container, said apparatus compensating for variations in atmospheric pressure, comprising:

a base for supporting the container;

a hood for creating a scaled environment for the container;

evacuation means for withdrawing a fluid from an interior of the container;

a vacuum sensor system, said vacuum sensor system comprising:

a first sensor for generating a first signal when a first preset vacuum level is reached;

a second sensor for generating a second signal when a second preset vacuum level is reached; and circuit means including a stored algorithmic factor and a timer means for determining an elapsed time period between said first and second preset vacuum level, said circuit means determining an additional time period for which the pump is to run to achieve a predetermined vacuum level in the container using said elapsed time period and said stored algorithmic factor.

6. The apparatus for vacuum sealing the container as recited in claim 5, further comprising a sealing means for creating an air-tight seal after evacuation of the fluid.

7. The apparatus for vacuum sealing the container as recited in claim 6, wherein sealing means comprises a heating element and a pressure profile.

8. The apparatus for vacuum sealing the container as recited in claim 5, further comprising a knife assembly for severing the container, wherein the container is a sealed plastic bag being severed from excess panels.

9. The apparatus for vacuum sealing the container as recited in claim 5, further comprising a lid attachment means in communication with the apparatus for evacuation of a non-elastic container.

10. A vacuum system for evacuating the container, comprising:

a chamber in communication with the container;

a pump in communication with the chamber for drawing fluid therefrom the chamber and the container;

a motor connected to the pump for driving the pump;

a first pressure sensor in communication with the chamber for sensing the pressure therein when the pressure level reaches a first preset level and for generating a first pressure signal to start a time count-down;

a second pressure sensor in communication with the chamber for sensing the pressure therein when the pressure level reaches a second preset level and for generating a second pressure signal to stop the time count-down;

a control means coupled to the first pressure sensor and the second pressure sensor to receive the first pressure signal and the second pressure signal therefrom, and including:

i) a stored algorithmic factor, i) means for calculating an elapsed time between the first pressure signal and the second pressure signal, iii) means for determining a time required to evacuate the container to a pre-determined vacuum level by multiplying said stored algorithmic factor by said elapsed time period.

11. A method for forming a vacuum in a container to a target vacuum level with a vacuum packaging device, the vacuum packaging device including a pump for evacuating the container, and a control circuit including a stored algorithmic factor, the method comprising the steps of:

(a) running the pump for evacuating the container;

(b) measuring a first time between a first vacuum level and a second vacuum level as the pump evacuates the container; and (c) computing a second time for which the pump must be run to reach the target vacuum level using said first time and the stored algorithmic factor.

* * * * *